US005878910A

United States Patent [19]

Gibernau et al.

[11] Patent Number: 5,878,910

[45] Date of Patent: Mar. 9, 1999

[54] DISPENSING MACHINE FOR PACKAGED FOOD PRODUCTS

[76] Inventors: Antonio Montserrate Gibernau, C. Avenir 72 E-08021, Barcelona; Antonio Bosch Clariana, Avenida Can Amat, 503-504, Urb. Can Amat, E-08781 Sant Esteve Sesrovires, both of Spain

[21] Appl. No.: 809,465

[22] PCT Filed: Jul. 12, 1996

[86] PCT No.: PCT/ES96/00146

§ 371 Date: Jul. 3, 1997

§ 102(e) Date: Jul. 3, 1997

[87] PCT Pub. No.: WO97/04427

PCT Pub. Date: Feb. 6, 1997

[30] Foreign Application Priority Data

Jul. 17, 1995 [ES] Spain ..... 9501495

[51] Int. Cl.[6] ..... A24F 27/14

[52] U.S. Cl. ..... 221/150 A; 219/753

[58] Field of Search ..... 221/150 R, 150 A; 219/679, 753, 762; 99/357

[56] References Cited

U.S. PATENT DOCUMENTS

| | | | |
|---|---|---|---|
| 3,838,790 | 10/1974 | Naruse | 221/150 HC |
| 4,783,582 | 11/1988 | Wada et al. | 219/10.55 R |
| 4,870,238 | 9/1989 | Hodgetts et al. | 219/10.55 M |
| 4,873,409 | 10/1989 | Spruytenburg et al. | 219/10.55 M |
| 4,937,413 | 6/1990 | Spruytenburg et al. | 219/10.55 B |
| 4,952,766 | 8/1990 | McDonald | 219/10.55 B |
| 5,144,879 | 9/1992 | Alessi | 99/327 |
| 5,147,068 | 9/1992 | Wright | 221/9 |
| 5,168,795 | 12/1992 | Okada | 221/150 A |
| 5,285,041 | 2/1994 | Wright | 219/717 |

FOREIGN PATENT DOCUMENTS

| | | |
|---|---|---|
| 2534126 | 4/1984 | France . |
| 8504743 | 10/1985 | WIPO . |
| 9213323 | 8/1992 | WIPO . |

*Primary Examiner*—Kenneth Noland
*Attorney, Agent, or Firm*—Steinberg & Raskin, P.C.

[57] ABSTRACT

The machine comprises a microwave oven (2), a supply system for supplying the products (P) to the oven, a device for expulsing the products from the oven and control means (6); said product supply system comprises a storage and dosage device (3), a device for collecting (4) the products and a device for introducing (5) the products in the oven (2). Conveniently, the device (3) has a plurality of conveyor belts (30) parallel to each other; the device (4) comprises a collector platform (47) mounted with respect to the structure with three degrees of freedom of translation, along three directions orthogonal to each other; the device (5) has a revolving arm with a fork. The production costs are of the machine reduced because it incorporates a conventional oven; the machine is also very versatile since it can dispense different types of packaged products recently prepared.

29 Claims, 6 Drawing Sheets

DISPENSING MACHINE FOR PACKAGED FOOD PRODUCTS

The present invention relates to a dispensing machine for packaged food products, of the type which before supplying the products processes them in a microwave oven. This machine can be applied, for example, to the sale of popcorn.

BACKGROUND OF THE INVENTION

There exist in the market bags containing grains of maize specially adapted for making popcorn in a microwave oven of the household type, simply by placing the bag in the microwave oven for a certain length of time. The bag inflates as the grains of maize expand to form the popcorn.

Known in the art commercially for the supply of recently made bags of popcorn is a dispensing machine with a simple system of gravity feed for the bags to take them into a microwave oven; this oven is provided with a loading door in its upper part and a finished-product expulsion door or hatch in its lower part.

These known machines nevertheless present a number of major disadvantages. On the one hand, the need to have a microwave oven of special construction increases the cost of the machine unacceptably; and on the other hand, the feed system for this dispensing machine is not entirely reliable, and the bags often become stuck or do not reach the oven correctly.

More specifically, on some machines the feed is implemented by means of vertical channels in which the products are stored in the form of a pile; the last of the products from the pile is driven by a piston and falls by gravity towards the oven. Such systems, similar to those used for cigarette machines and the like, are not suitable for products with irregular packaging, such a popcorn bags, for the bag is often poorly positioned in relation to the piston and blockages occur or the pistons fails to push any of the product; moreover, the bags can be oily and not slide correctly along the ramps which take them to the oven, so that these machines end up presenting undesirable operating defects.

The right cooking time for the popcorn depends on several parameters, such as the type and size of maize grain, humidity, ambient and product temperatures, wear of the magnetron, and others. On the known machine described, cooking control is limited to a timer which switches the oven off after a preset time, so that cooking time cannot be varied; this is a major limitation, for it means that some grains do not burst, some bags may even catch fire, etc.

Another disadvantage of this machine is that it permits the supply of only one specific product, while it would be desirable for one machine to be able to supply several different articles, at the choice of the customer.

DESCRIPTION OF THE INVENTION

The present invention aims to resolve the above-mentioned disadvantages by offering a dispensing machine which is reliable in operation, uses a conventional microwave oven and is also versatile, so that it can supply different articles of food.

In accordance with this objective, the packaged food product dispensing machine of the invention comprises a structure which has an associated payment device and contains a microwave oven, a system for supply of the packaged products to the microwave oven, a device for expulsion of the packaged products from the microwave oven, and means of controlling operation. The machine is characterized in that said system for supply of packaged products to the microwave oven includes a storage and dispensing device for the packaged products, a device for collecting said products from the storage and dispensing means, and a device for placing the packaged products in the microwave oven.

The product itself requires no handling, remaining within its package at all times, which ensures optimum hygiene conditions, and it is supplied to the user recently cooked, which means that it does not present the disadvantages of products which are sold some time after they are made, but has excellent taste and consistency characteristics.

A notable advantage of the machine of the invention is its versatility, since it permits the supply of different packaged products, at the choice of the user, such as popcorn with or without salt, sugar, butter and other flavourings, pork scratchings and other products which are best cooked or heated up on the spot in a microwave oven, which was impossible with the known machines.

Furthermore, this machine uses a conventional microwave oven, with a front-fitted door, thanks to providing the product pick-up device and device for placing product in the oven, so that the cost of the machine is kept at a reasonable level.

In a preferred embodiment of the machine, the packaged product storage and dispensing device includes a plurality of conveyor belts running parallel to each other, each one of the conveyor belts being provided with separating plates articulated onto the belt around spindles mounted transversally to the direction of the belt, one packaged product being placed between each two separating plates, and each of the said conveyor belts being provided with means for moving forward a predetermined distance.

A different product can be placed on each conveyor belt, and the separating plates allow the packages to be kept in vertical position, thereby occupying a much smaller space and taking maximum advantage of the carrying capacity of the belts.

Advantageously, the conveyor belts are mounted in compartments which can slide on guides fixed to the structure of the machine and can be removed from the front part of the machine for loading packaged products onto the conveyor belts.

This facilitates the operation of loading products into the machine.

In accordance with a preferred mode of embodiment of the machine, the pick-up device includes a collecting platform fitted in relation to the structure with three degrees of freedom of movement, in accordance with three directions orthogonal to each other.

These three degrees of freedom of movement allow the platform to be situated to coincide with the outlet end of any of the conveyor belts in order to collect the product.

Preferably, the machine includes: at least a first guide, fixed to the structure and running in a first, horizontal, direction, along which a first carriage can travel; at least a second guide, attached to said first carriage, which runs in a second, vertical, direction, along which a second carriage can travel; and at least a third guide, attached to said second carriage, which runs in a third direction, horizontally and perpendicularly both to the first direction and the second direction, and along which said collecting platform can travel.

Also preferably, the first carriage travels along the first guide by means of a pinion and slide mechanism, the second carriage travels along the second guide by means of a chain and sprocket mechanism, and the collecting platform travels along said third guide by means of a spindle.

The mechanisms for movement of the collecting platform are precise and reliable, permitting good positioning of the platform and operation without annoying noises and vibrations.

An advantageous aspect of the machine design is that the collecting platform is also articulated around a spindle horizontal and perpendicular to the direction of said third guide, and rotates around said spindle, moving from a horizontal position to an inclined position, at the end of the travel along said third guide.

Inclination of the platform facilitates picking up of the product from the conveyor belts and prevents it being poorly placed.

Preferably, said collecting platform has an optical sensor capable of identifying a code provided for the purpose on the product package and of checking the correction positioning of the package on the platform.

The product will thus be well situated in the oven and at the same time the type of product used with the machine can be controlled, thereby preventing potential fraud.

In an advantageous embodiment of the invention, the inserting device comprises a rotating arm whose free ends moves between a first position in which the collecting platform supplies it with a packaged product and a second position, which is angularly out of phase with respect to said first position and in which the free end of the arm is inside the oven, into which it lets the packaged product drop.

Preferably, the free end of the arm is provided with a fork, which is normally kept in horizontal position, on which fork the collecting platform places the packaged product by means of a vertical, downward shifting movement, the said platform having for the purpose a pair of parallel grooves whose position during said vertical movement coincides with that of the branches of the fork on the arm.

Also preferably, said fork which is normally kept in horizontal position is provided with a rotating mechanism which forces it to rotate until it is positioned in an inclined plane, said rotating mechanism being driven by contact of the arm with the interior wall of the oven, when the arm reaches the second position.

The arm constitutes a simple mechanism for transportation of the product from the collecting platform to the interior of the oven, obviating a need to provide an oven with special openings for loading.

In accordance with another characteristic of the invention, the microwave oven, which is of conventional type, is mounted on a pair of horizontal guides, moving between one product-insertion position and a cooking position, while the door of the oven has an associated bushing along which a guide attached to the machine structure travels, so that the oven door closes when the oven is moved from the insertion position to the cooking position, and opens when it moves in the opposite direction.

The product-insertion position coincides with said second position of the rotating arm, so that the arm places the product in the oven when the latter is in said insertion position, with the door open.

The movable mounting of the oven and the door opening and closing mechanism facilitate the operations of inserting and expelling the product.

The device for expulsion of the packaged product from the oven advantageously consists in a curved bar, fixed to the interior side of the oven door at a predetermined height, said height being such that the packaged product, before being processed in the oven, can pass beneath said bar, but on the other hand interacts with same when it has been processed due to its increase of volume, leading to expulsion thereof during the movement of the oven from the cooking position to the insertion position, as the door opens, the product being expelled onto a ramp for falling toward the exterior of the machine.

In one embodiment, the control means include a programmable cooking timer, which disconnects the power supply of the oven and initiates its travel in order to expel the product when the time programmed on the timer has elapsed.

Advantageously, on a machine specially designed for the supply of popcorn, the control means include an acoustic sensor capable of detecting the bursting of the popcorn grains, the programmable cooking timer being set in accordance with the frequency of the bursts detected by the aforesaid sensor.

With this system, the cooking timer is reprogrammed in each cycle, the cooking time increasing or decreasing in function of the frequency of the bursts, and therefore permitting the popcorn to be cooked optimally, depending on its quantity, grain size, temperature, humidity, etc., and also on the wear of the microwave oven magnetron.

The control means preferably include a safety mechanism which disconnects the oven when a sensor detects the presence of smoke.

In addition, or alternatively, the control means include a safety timer which disconnects the oven after a certain preset time of operation, thus, even if a breakdown of the sensors or other parts of the system occurs, the oven is disconnected.

The machine also includes, preferably, a system for cleaning and evacuation of the residues includes the oven produced by cooking.

Such a system prevents the accumulation of grease and other residues which may be left in the oven and which, if not eliminated, could catch fire.

Advantageously, said cleaning and residue evacuation system comprises a roll of absorbent paper fitted beneath the level of the oven, said absorbent paper passing over a shuttle roller situated in the bottom of the oven and by a dragging system situated outside the oven, so that the product to be cooked is placed on said paper inside the oven, and means to cut the paper after it has passed through the dragging system.

Any residue is thereby eliminated from the oven along with the corresponding piece of paper.

In order to avoid breakages, there may also be a continuous strip of flexible material fitted between the dragging system and the shuttle roller, in order to support the paper and the product to be cooked.

In one embodiment of the invention the machine also includes at least one refrigerated storage zone.

The existence of a refrigerated zone allows the machine to be used also for precooked products, such as pizzas and the like.

Advantageously, said refrigerated storage zone contains at least one of the aforesaid conveyor belts, and has a product discharge door controlled by opening and closing means synchronized with the movement of the belt itself.

In one embodiment, the machine further includes an intermediate storage device, with capacity for one unit of each type of product supplied by the machine, in such a way that in each cycle the pick-up device supplies the oven with a unit of product stored in the intermediate storage device and then places another unit of product from one of the conveyor belts and replaces it into the intermediate storage device.

The time taken to supply a product to the user is thereby reduced.

One embodiment of the machine structure includes a front section on which are provided the payment device, some buttons for selection of the desired product, a display screen, an oven viewing window, an opening associated with the end of the fall ramp and an indicator to show the time remaining for supply of the product.

BRIEF DESCRIPTION OF THE DRAWINGS

For a better understanding of all that has been set out some drawings are attached in which, schematically and solely by way of non-restrictive example, a practical case of embodiment is shown.

In said drawings.

DESCRIPTION OF A PREFERRED EMBODIMENT

Figure 1:
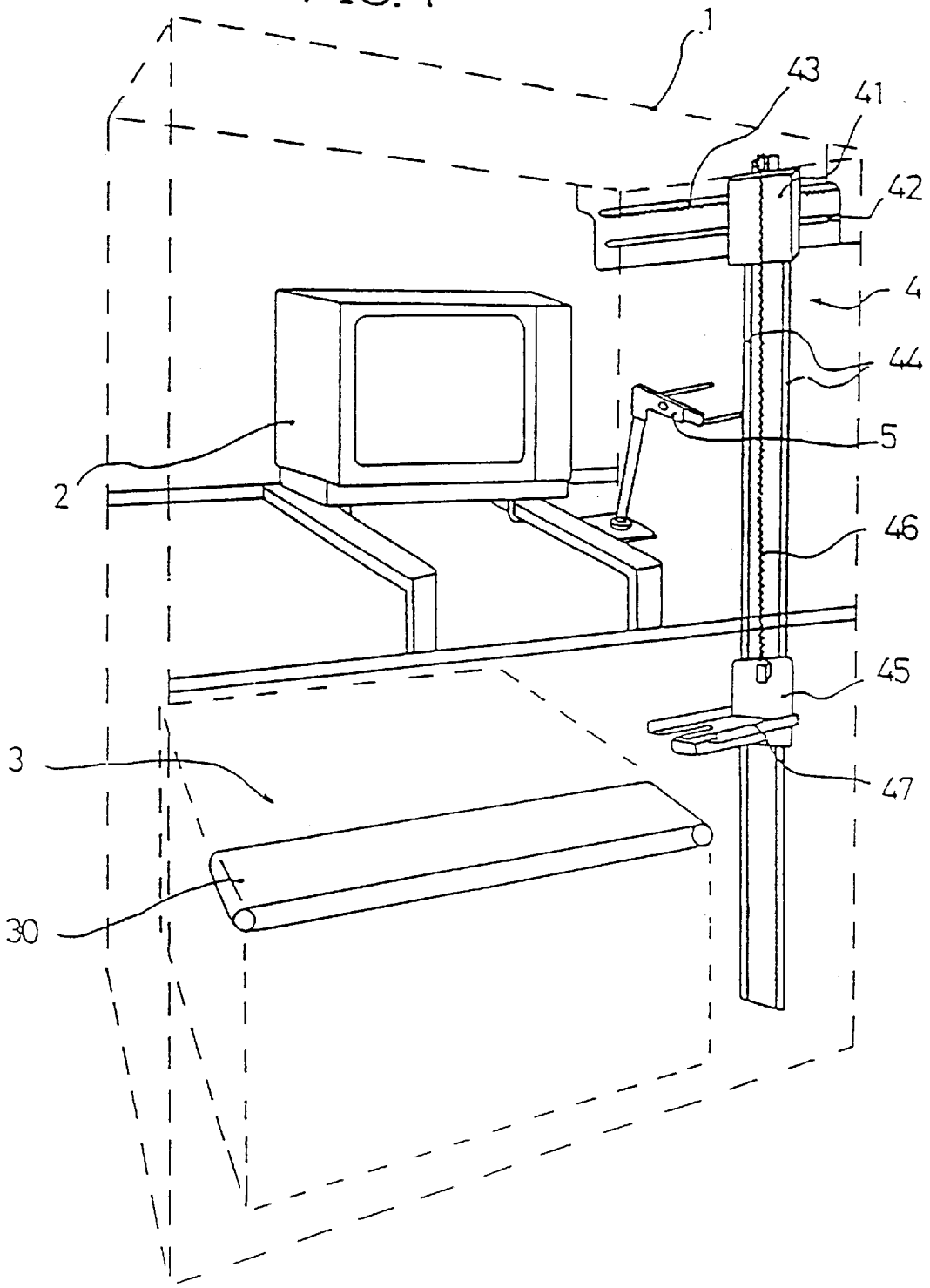
FIG. 1 is a perspective view of the machine without its exterior casing, in order to show schematically the main components of same.

As can be seen in the schematic view of FIG. 1, which shows the structure 1 of the machine in broken lines in order to simplify the drawing, the machine of the invention comprises a microwave oven 2, of conventional type, a storage and dispensing device 3 for some packaged products, a product pick-up device 4 and a device 5 for inserting the products into the oven 2.

The machine also incorporates a conventional device for payment for and selection of products (not shown), means for controlling the operation, shown for greater clarity as a single block 6, and a device 7 for expulsion of the packaged products from the oven, which is not shown in FIG. 1 but will be described below.

Figure 2:
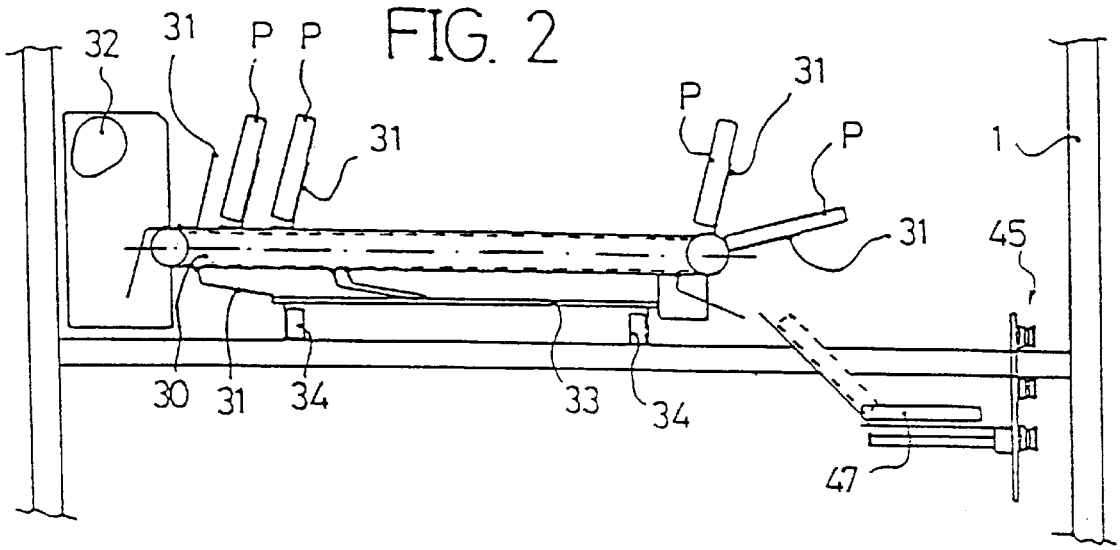
FIG. 2 is an elevation view of one of the conveyor belts of the machine.

In the embodiment shown, the storage and dispensing device 3 consists in a number of conveyor belts 30, on which are placed the packaged products P to be supplied, as shown in greater detail in FIG. 2.

As can be seen in this figure, each of the conveyor belts 30 includes a number of parallel separating plates 31; a product P is placed between every two plates. The belt is driven with a step-by-step movement by a motor 32, which has been shown only schematically and is of course connected to the control means 6.

When the belt advances by a predetermined step, a product P is supplied from the outlet end of the belt.

The plates 31 are articulated with respect to the belt; thus, when a plate reaches the outlet end of the belt and the product it holds is supplied, the plate is left situated at the lower part of the travel of the belt, comes into contact with a surface 33 and is folded, occupying a space much lower in height.

The conveyor belts 30 are all parallel to each other and there can be any suitable number of them (nine, for example), set at several levels; those on each level (three, for example) being mounted in a compartment which can be removed from the front part of the machine by sliding on some guides 34.

From one of the belts 30, a product P drops onto a platform of the pick-up device 4. As shown in FIG. 1, this device in essence consists of a first carriage 41, which moves along horizontal guides 42, thanks for example to a rack and pinion mechanism 43; to this carriage are attached two vertical guide rods 44, along which a second carriage 45 moves by, for example, a sprocket and chain mechanism 46.

The platform 47 which receives the product P is mounted on the second carriage 45 in the manner described below with reference to FIGS. 3 and 4*a*,4*b*.

The second carriage 45 comprises a base 450 which slides along the guide rods 44 hanks to suitable wheels 451; mounted on the base 450 are a spindle 452, driven in rotation by a motor (not shown) which is connected to the control means of the machine, and a guide 453. When the spindle 452 rotates, a block 454, with a female screw thread complementary to that of the spindle, moves along the guide 453.

Figure 4A:
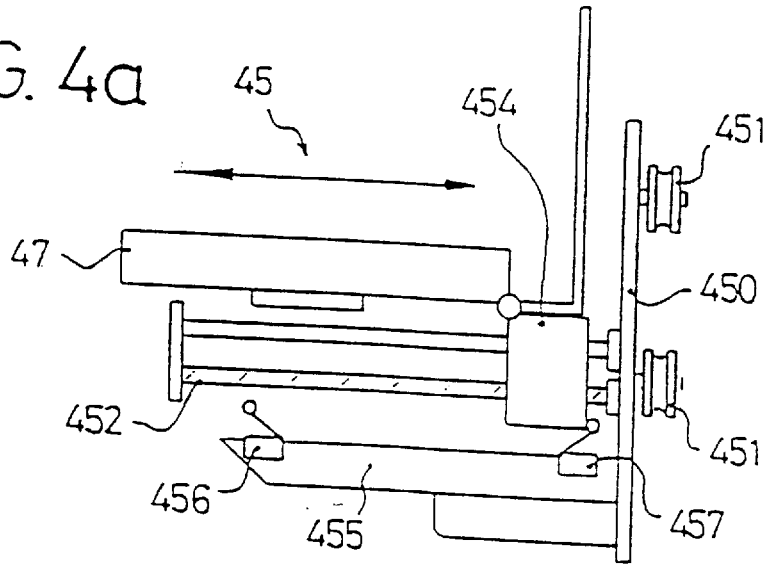
FIGS. 4*a* and 4*b* show the collecting platform of FIG. 3 in side elevation view.

The collecting platform 47 is mounted articulated ion the block 454, in such a way that both parts move in the direction indicated by an arrow in FIG. 4*a*.

Underneath the spindle 452 and the block 454, the base holds up a small support 455, on which are mounted end-of-run stops 456,457, whose function is to stop the movement of the block and induce rotation of the platform towards an inclined position (FIG. 4*b*) and towards a horizontal position, respectively, when the block 454 reaches the two end positions of its travel.

Figure 4B:
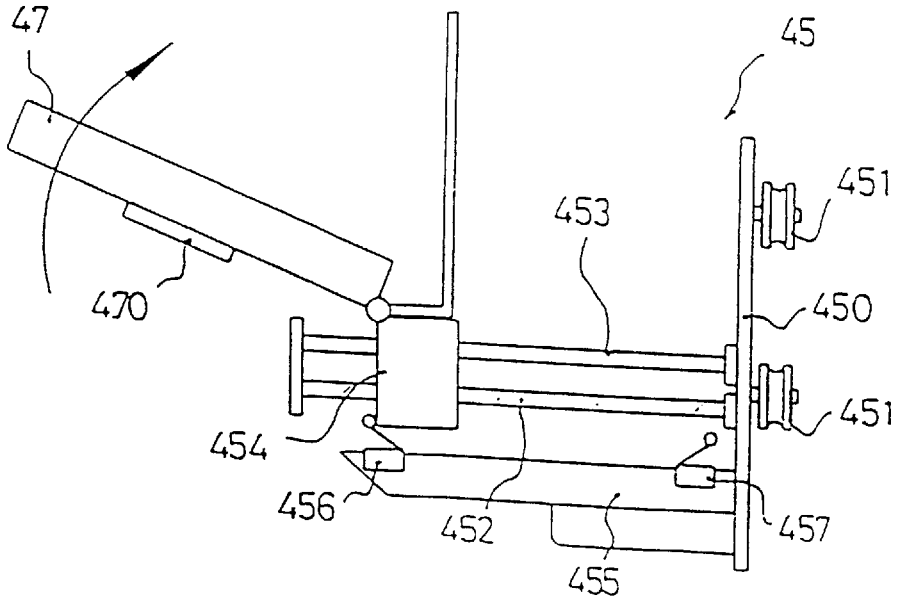

The collecting platform 47 consequently has an "advance" movement (moving away from the base) in a horizontal position, as shown in FIG. 4*a*, and a "backward" movement (drawing closer to the base) in an inclined position, as shown in FIG. 4*b*.

Figure 3:
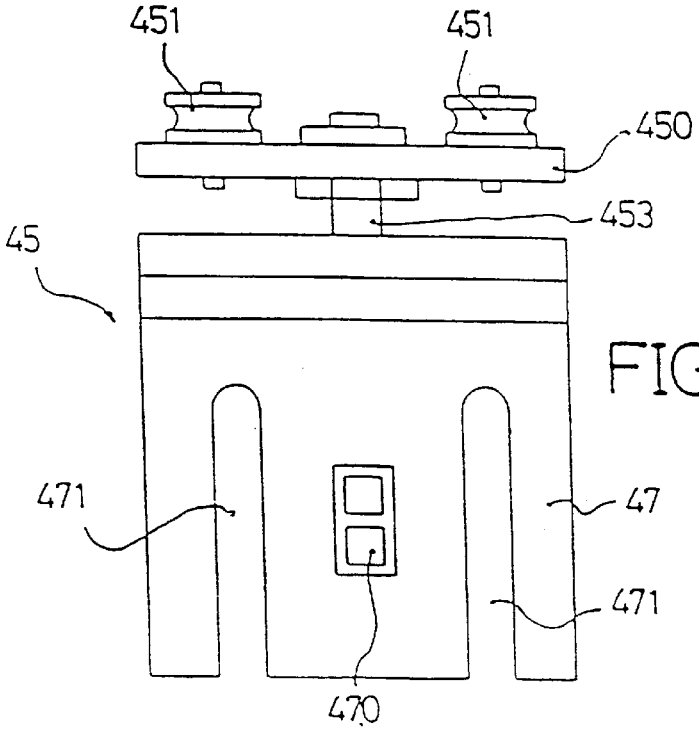
FIG. 3 is a plan view of the collecting platform incorporated into the machine, in two different positions.

Finally, the collecting platform 47 has an optical sensor and two parallel grooves 471, as can be better appreciated in the plan view of FIG. 3.

The collecting platform therefore has three degrees of freedom of shifting according to three orthogonal axes and can also rotate around a spindle; as will be explained in greater detail when describing the operation of the machine, this platform has the purpose of transporting the products P from the conveyor belts 30 to the device 5 which places them in the oven 2.

Figure 5:
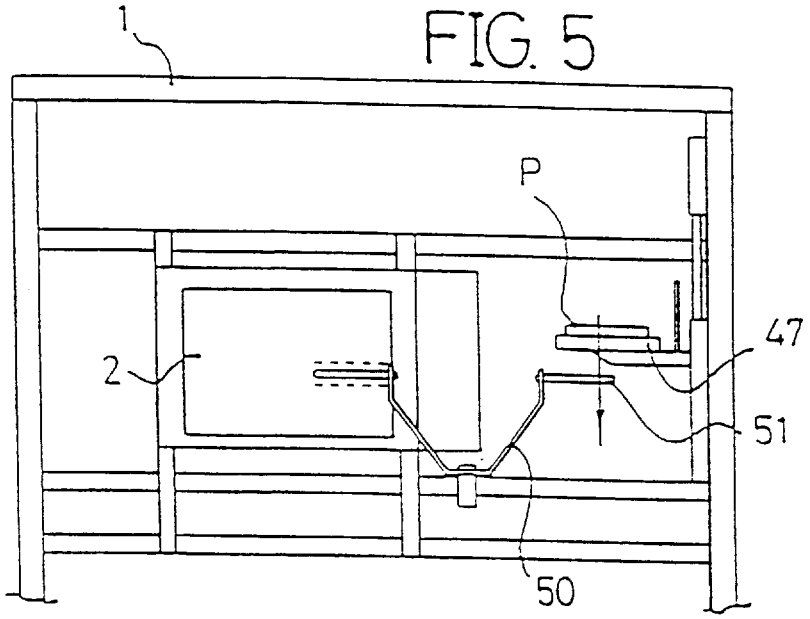
FIGS. 5 and 6 show front elevation and plan views, respectively, of the device for inserting products into the oven.
Figure 6:
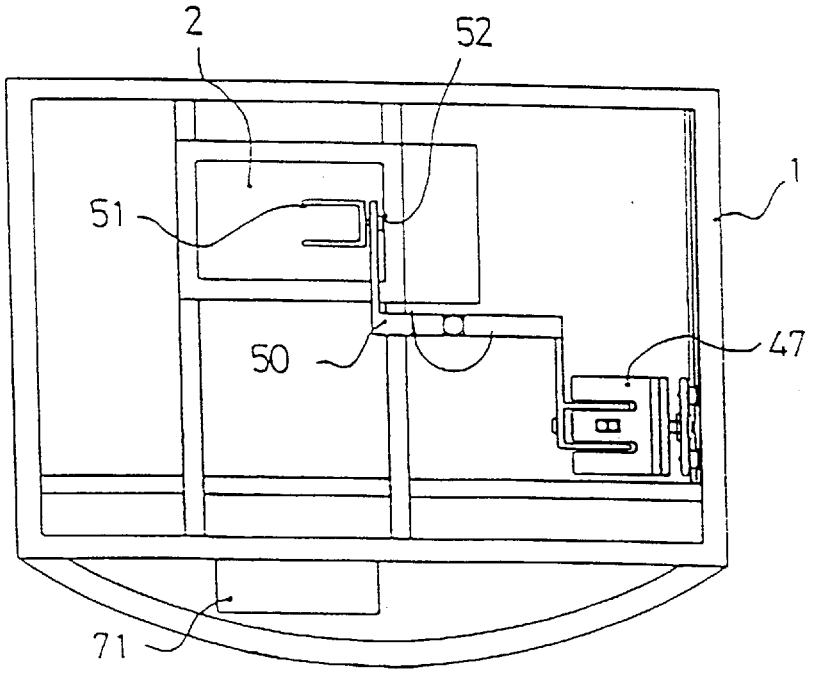

This device 5 is shown in elevation and plan views in FIGS. 5 and 6, respectively; in both figures the device is shown in two end positions of its movement.

In the preferred embodiment, the device 5 consists in an arm 50, which has a rotating movement about a vertical spindle governed by the control means 6.

The free end of the arm moves under the effect of the rotation movement between a first position (on the right in the figures), in which it coincides approximately with the collecting platform 47 so that the latter can supply it with a product P, and a second position (on the left in the figures), in which the free end of the arm 50 is inside the oven 2, which in this situation has its door open, as will be explained below.

On one end of the arm 50 is mounted a fork 51, which is normally kept horizontal, and which serves to hold the product P during movement of the arm 50.

Movement of the product P from the platform 47 to the fork 51 is implemented by a downward, vertical shifting movement of the platform, as shown by the arrow of FIG. 5; the two branches of the fork 51 pass through the grooves 471 of the platform.

The fork 51 is provided with a rotating mechanism (not shown in detail) which forces it to rotate until it is positioned in an inclined plane, when the arm reaches the second position, that is, when it is inside the oven 2, in order to let the product P drop.

Figure 7A:
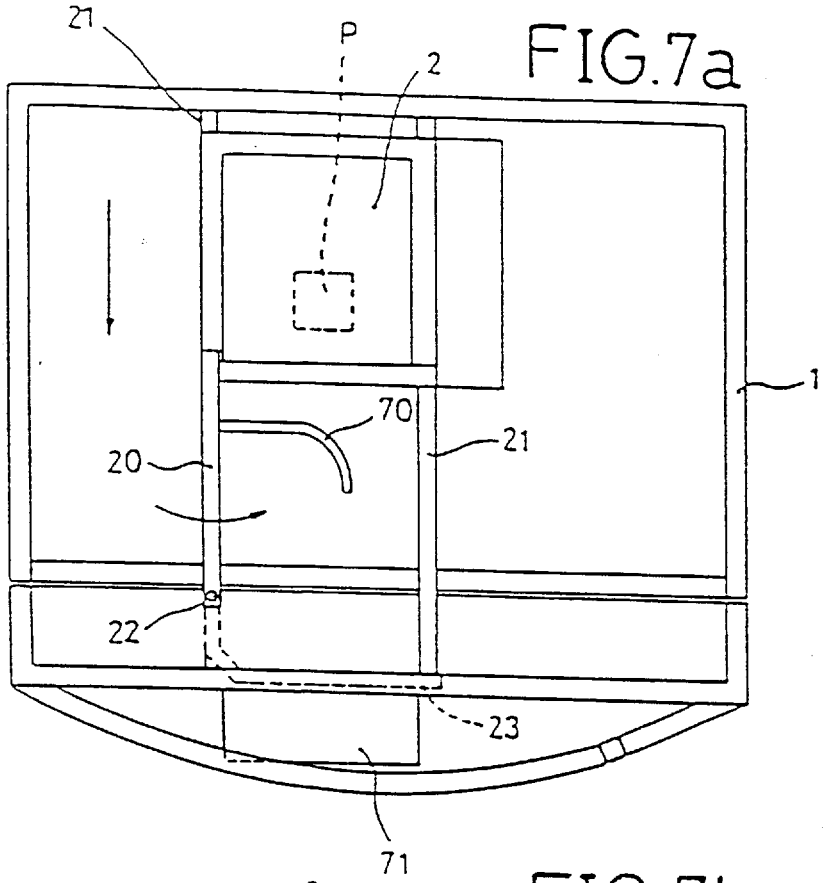
FIGS. 7*a* and 7*b* show the two positions which the oven adopts during the operating cycle.
Figure 7B:
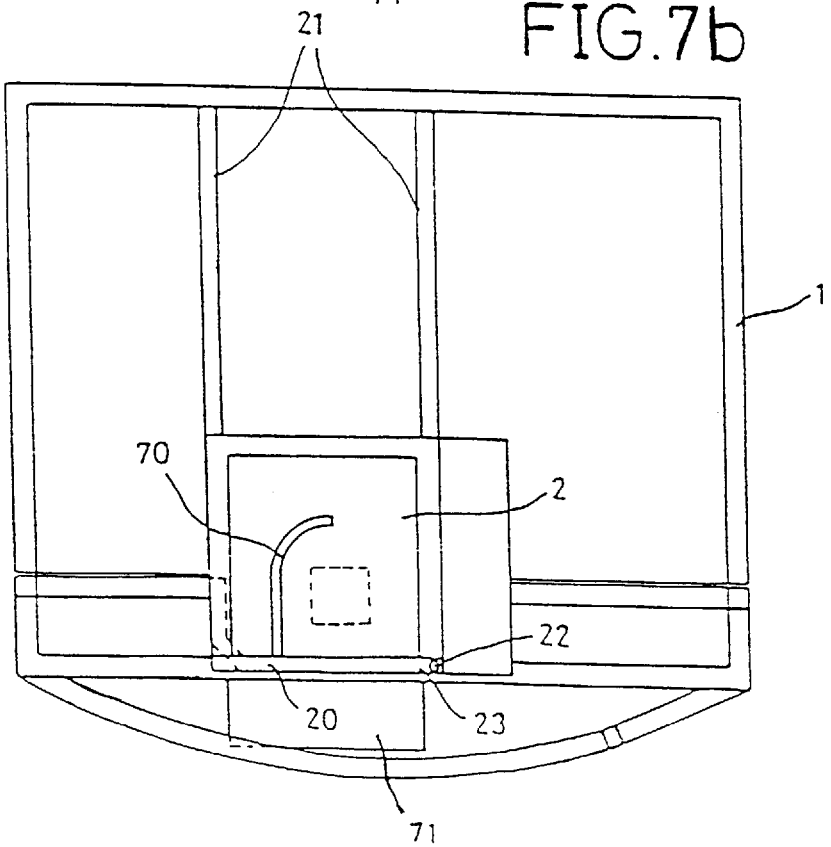

In FIGS. 7*a* and 7*b* the microwave oven 2, of conventional type and with a door 20, is shown mounted in the machine. The oven 2 is mounted on two horizontal guides 21 fixed to the structure 1, and can move governed by the control means 6 between the product insertion position illustrated in FIG. 5 and the cooking position illustrated in FIG. 6.

In the first of these positions the door 20 is open, and the oven is near the rear part of the machine; in order to go to the cooking position, the oven moves towards the front part of the machine, while a bushing 22 which travels along a guide 23 attached to the structure of the machine causes the door 20 to close.

Fixed to the door 20 of the oven is a curved bar 71, which constitutes the means of expulsion of the product P from the machine; to this end, the bar 70 is mounted in the oven at a height such that, when the package is placed in the oven with the raw product (such as grains of maize) the arm does not come into contact with the package, while, once the product (popcorn) is cooked, the package has increased in volume and the bar pushes it towards the exterior.

Beneath the most advanced position of the oven 2 (cooking position) is a drop ramp 71, upon which drops the product P expelled by the bar 70, for transfer of the product to the exterior of the machine.

The machine also includes means for cleaning and evacuation of the residues produced by cooking.

Figure 8A:
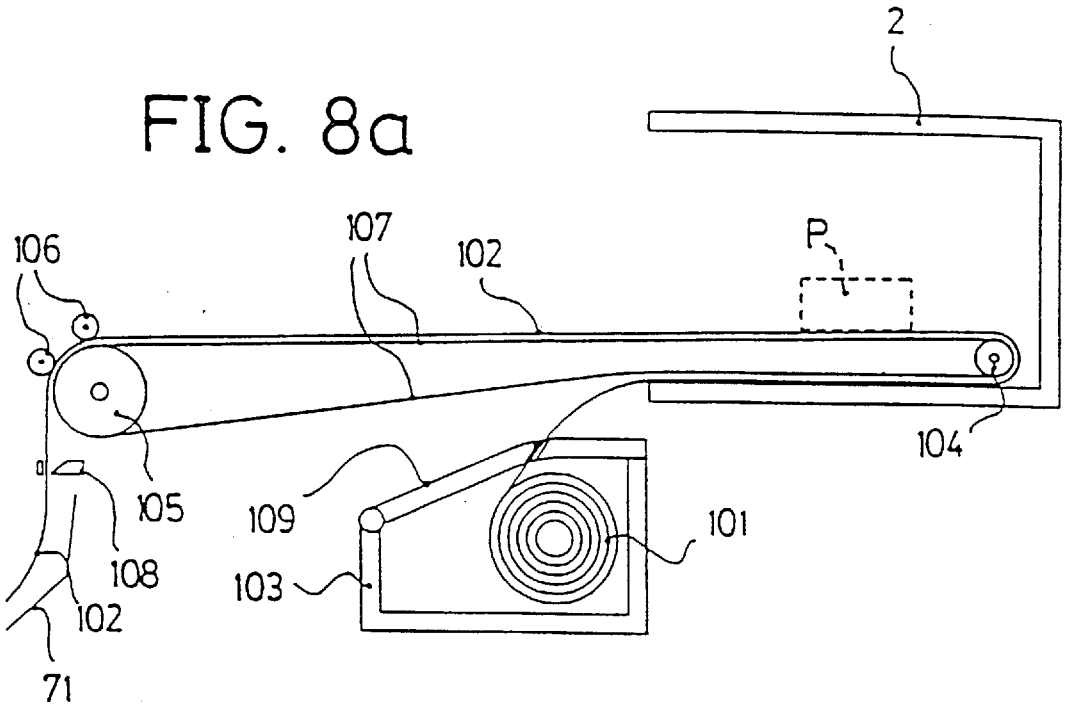
FIGS. 8*a* and 8*b* show an embodiment of a device for cleaning the oven, in two operating positions.
Figure 8B:
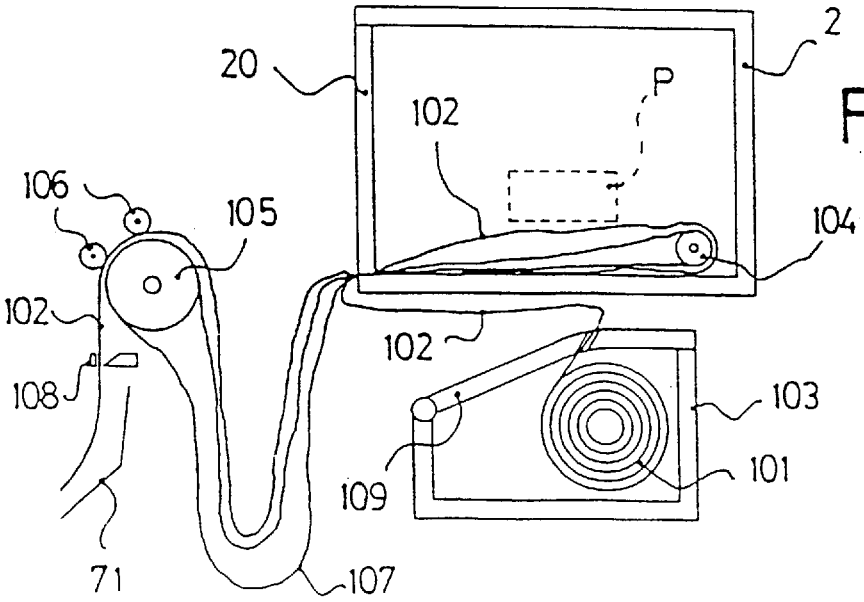

One possible embodiment of the means of cleaning is shown in a very schematic way in FIGS. 8*a* and 8*b,* with the horn shown in side elevation in its two end positions (corresponding to FIGS. 7*a* and 7*b,* respectively).

As can be seen in FIG. 8*a,* a roll of paper 101 of absorbent type 102 has been provided, housed in a compartment 103 fixed to the structure of the machine beneath the level of the oven 2. From this compartment 103 the paper passes inside the oven (being left underneath the door 20 when the latter is closed, as shown in FIG. 8*b*) and around a shuttle roller 104 fitted on the back of the oven, from where it passes again to the exterior of the oven and comes into contact with a dragging system made up of a drag roller 105 and two small pressure rollers 106.

The product P to be cooked is placed on the strip of absorbent paper 102, in such a way that any possible trace of oil or other residues is removed from the oven when the paper 102 is made to advance.

In this embodiment of the cleaning means, the strip of paper 102 itself is used to transfer the product P to the exterior of the oven and up to the drop ramp 71; in this case, therefore, it is not essential to have the curved bar 70 for expulsion.

In order to provide a better support for the paper, and especially for the product, allowance is also made for the existence of a fine strip 107 of a material suitable for microwaves, fitted around the rollers 104 and 105.

Both the strip of plastic material 107 and the strip of paper 102 are tensed when the oven is in the loading position (FIGS. 7*a*and 8*a*), while when the oven passes to the cooking position the two strips 102 and 107 are slackened (FIG. 8*b*).

Once the product P has been cooked and the oven 2 returns again, the dragging movement through the roller 105 is set in motion, in such a way that the product P and the paper 102 which supported it in the oven advance and drop onto the fall ramp 71; a guillotine 108 cuts the paper, which is therefore supplied together with the product, for use as a serviette.

The compartment 103 has an articulated cover 109, with a slot for passage of the paper, while it also serves as support and guide for the strip 107.

In a variant of embodiment of the machine, the possibility is envisaged of supplying other types of products, such as buns, pizzas, etc.

In this case, some of the products may be frozen, which means that the machine must have at least one refrigerated storage zone; for example, one of the compartments with the conveyor belts 30 would in this case be contained in an insulated casing refrigerated by a small conventional refrigerating device, and would have a discharge door which opened and closed governed by the control means 6 so as to synchronize with the movement of the belt 30 and the collecting platform 47.

According to one possible embodiment of the machine (not shown in the drawings), an intermediate storage device is provided, with capacity for one unit of each of the products to be supplied; one product is initially placed in the different sectors (one for each type of product), in such a way that when the machine must supply a product to a user the pick-up device 4 does not take it from one of the conveyor belts 30 but from a sector of the intermediate storage device, which is then left empty. In this way, the time taken for placement of the product in the oven is shorter, and so the total time for supply of the product to the customer is also shorter. While the oven cooks the product, the pick-up device 4 makes another movement to pick up another product the same as the one supplied and to leave it in the sector of the intermediate storage device which had been left empty.

In the case of bun products and the like, the means of expulsion of the product from the oven will be different from those described.

It is also envisaged that some of the products which can be supplied from the machine would not have to be cooked in the oven, and could therefore be supplied directly from the pick-up device 4 or from the arm 50 with fork to the drop ramp 71 of the machine.

The operation of the embodiment of the machine shown in the figures is as follows:

Initially, the oven 2 is in the product-insertion position and with the door open, the inserting arm 50 is in the product-reception position, and the collecting platform 47 is at rest in the top part of the machine.

The products to be supplied are stored on the conveyor belts 30, there can be a different product on each belt (popcorn with salt, with sugar, with butter, etc., pork scratchings and others), or several belts can have a single product; the pertinent parameters having simply to be programmed suitably on the control means 6 in order to coordinate user selections with the corresponding conveyor belt, cooking time, etc.

A user sets the operating cycle under way by putting money into the payment device of the machine and selecting the product desired.

The carriages 41 and 45 move, and the collecting platform 47 situates itself at the outlet from the conveyor belt 30 on which the product P selected is situated, advancing and moving to inclined position to receive the product.

The conveyor belt 30 then advances a preset distance and the product P drops onto the inclined platform.

Through the optical detector 470, the control means check that the bag is positioned correctly and that its coding is that of the product selected.

The carriages 41 and 45 then move to situate the platform 47 in the position for product delivery to the fork 51 of the rotating arm 50; the platform returns to the horizontal position and the carriage 44 begins the descent, so that the product is placed on the fork 51.

The arm then rotates until the rotating mechanism 52 comes into contact with the interior wall of the oven, so that the fork 51 swivels and lets the product P drop into the oven.

Once the arm 50 has withdrawn, the oven goes into the cooking position while the door closes, and the cooking time starts.

During cooking the user can see the inside of the oven through a window (not shown) provided on the front of the machine.

The cycle ends with the oven moving again to the position of insertion and door opening, which causes expulsion of the finished product P by means of the curved bar 70. The user can thus receive the product P straight from the oven by means of the ramp 71.

In the event of the cleaning means of FIGS. 8*a* and 8*b* being adopted, the only operational variation would be that expulsion of the product occurs by advance of the strip 107 and the paper 107, and that together with the product, as described above, a paper serviette would be supplied.

If during operation the control means detect any anomaly (such as wrong product or product poorly placed ion the platform), an interrupt cycle is initiated, in such a way that the pick-up device 4 leads the product to a discharge position (not shown) and issues an error message, refunding the money to the user or reinitializing the process if necessary.

Finally, mention will be made of some characteristics of the control means 6 which govern the described operation of the machine.

The control means 6 are connected to the payment device (not shown), from which they receive the signal for activation of a particular cycle, in accordance with the product selected by the user; these means govern all the moving parts of the machine, such as the pick-up device 4, the oven 2, the conveyor belts, etc. They likewise receive the signals from the various sensors, end-of-run stops and other conventional control parts fitted onto the machine.

Special mention should be made of the part of the control system which governs machine cooking time, specially designed for the case of popcorn.

In principle, the oven is provided with a cooking timer which is set by the control means to a predetermined cooking time, which depends on the product: for a bag of popcorn of a certain size and shape, for example, the cooking time is initially set at 2 minutes.

There are nevertheless a number of factors which make it advisable to adjust the timer periodically, in order to avoid the possibility of unburst grains remaining or the bag remaining too long in the oven, with the risk of it even catching fire. Amongst these factors are wear of the oven magnetron, product humidity, maize grain size, etc.

In order to set the cooking time to take account of a combination of all these factors, the present invention provides for the incorporation of an acoustic sensor capable of detecting the bursts of the popcorn in the oven.

Every ten cooking cycles, for example, and after a preset initial pre-cooking time (during which there are practically no bursts), a counter measures the time during which the sensor detects successive bursts of the popcorn; when no bursts are detected (for two seconds, for example), the counter stops. If the counter time is shorter than a certain reference, the cooking timer is set for a shorter time for the next cycles; if the counter time is longer than a certain other reference, then the cooker timer is set to lengthen the cooking time for the next cycles.

The machine also has means for detecting the actual presence of the package in the oven after the package has been inserted, and for detecting when the product has been expelled at the end of the cycle.

The machine is provided with several safety mechanisms in order to ensure its safe operation: in particular, the machine has an inbuilt sensor for the detection of smoke, so that the control means can disconnect the oven in the event of fire, and a safety timer which causes disconnection of the oven and reinitialization where a cycle exceeds a certain time, which would indicate an operating anomaly.

The front part of the machine is provided with the payment and product selection devices, a display screen to provide informative messages for users, the oven viewing window and opening device, associated with the end of the drop ramp, via which products are supplied to the users.

The design also allows for the fitting of a product-supply remaining-time indicator, for example, in the form of a two-digit countdown counter.

The machine can also be fitted with a modem to connect the control system to the telephone line and thus be able to control remotely on the one hand the various operating parameters and, on the other, the stocks of each of the various products.

Despite a preferred embodiment of the machine object of the invention having been described and shown in the drawings, is it clear that an expert in the subject would be able to introduce variants and modifications, in accordance with the specific requirements of each case, and that all the technical details could be replaced by other equivalent ones, without departing from the sphere of protection defined by the attached claims.

We claim:

1. Dispensing machine for packaged food products (P), which comprises a structure (1) which has an associated means of payment and which contains a microwave oven (2), a system for supply of packaged products to the microwave oven, a device for expulsion of the packaged products from the microwave oven, means of control (6) of operation, and a system for cleaning and evacuation of the residues inside the oven (2) produced by cooking, said system for supply of packaged products to the microwave oven including a storage and dispensing device (3) for the packaged products (P), a device (4) for collecting said products (P) from the storage and dispensing device (3), and a device (5) for placing the packaged products in the microwave oven (2).

2. Dispensing machine as claimed in claim 1, wherein said packaged product storage and dispensing device (3) includes a plurality of conveyor belts (30) running parallel to each other, each one of the conveyor belts being provided with separating plates (31) articulated onto the belt around spindles mounted transversally to the longitudinal direction of the belt, one packaged product (P) being placed between each two separating plates (31), and each of the said conveyor belts being provided with means (32) for moving forward a predetermined distance.

3. Dispensing machine as claimed in claim 2, wherein said conveyor belts (30) are mounted in compartments which can slide on guides (34) fixed to the structure (1) of the machine and can be removed from the front part of the machine for loading packaged products (P) onto the conveyor belts (30).

4. Dispensing machine as claimed in claims 1, wherein said pick-up device (4) includes a collecting platform (47) fitted in relation to the structure with three degrees of freedom of movement, in accordance with three directions orthogonal to each other.

5. Dispensing machine as claimed in claim 4, further comprising at least a first guide (42), fixed to the structure (1) and 5 running in a first, horizontal, direction, along which a first carriage (41) can travel;

at least a second guide (44), attached to said first carriage (41), which runs in a second, vertical, direction, along which a second carriage (45) can travel; and at least a third guide (453), attached to said second carriage, which runs in a third direction, horizontally and perpendicularly both to the first direction and the second direction, and along which said collecting platform (47) can travel.

6. Dispensing machine as claimed in claim 5, wherein the first carriage (41) travels along the first guide (42) by means of a pinion and slide mechanism (43), the second carriage (45) travels along the second guide (44) by means of a chain and sprocket mechanism (46), and the collecting platform (47) travels along said third guide (453) by means of a spindle (452).

7. Dispensing machine as claimed in claim 4, wherein the collecting platform (47) is also articulated around a spindle horizontal and perpendicular to the direction of said third guide, and rotates around said spindle, moving from a horizontal position to an inclined position, at the end of the travel along said third guide (453).

8. Dispensing machine as claimed in claim 4, wherein said collecting platform (47) has an optical sensor (470) capable of identifying a code provided for the purpose on the product (P) package and of checking the correction positioning of the package on the platform (47).

9. Dispensing machine as claimed in claim 4, wherein said inserting device (5) comprises a rotating arm (50) whose free ends moves between a first position in which the collecting platform (47) supplies it with a packaged product (P) and a second position, which is angularly out of phase with respect to said first position and in which the free end of the arm (50) is inside the oven (2), into which it lets the packaged product (P) drop.

10. Dispensing machine as claimed in claim 9, wherein the free end of the arm (50) is provided with a fork (51), which is normally kept in horizontal position, on which fork the collecting platform (47) places the packaged product (P) by means of a vertical, downward shifting movement, the said platform (47) having for the purpose a pair of parallel grooves (471) whose position during said vertical movement coincides with that of the branches of the fork (51) on the arm.

11. Dispensing machine as claimed in claim 10, wherein said fork (51) which is normally kept in horizontal position is provided with a rotating mechanism (52) which forces it to rotate until it is positioned in an inclined plane, said rotating mechanism (52) being driven by contact of the arm with the interior wall of the oven (2), when the arm reaches the second position.

12. Dispensing machine as claimed in claim 1, wherein the microwave oven (2) is of conventional type and is mounted on a pair of horizontal guides (21), moving between one product-insertion position and a cooking position and by the fact that the door (20) of the oven (2) has an associated bushing (22) along which a guide (23) attached to the machine structure travels, so that the oven door (20) of the oven closes when the oven is moved from the insertion position to the cooking position, and opens when it moves in the opposite direction.

13. Dispensing machine as claimed in claim 9, wherein said product-insertion position of the oven (2) coincides with said second position of the rotating arm (50), so that the arm places the product in the oven (2) when the latter is in said insertion position, with the door (2) open.

14. Dispensing machine as claimed in claim 12, wherein the device for expulsion of the packaged product from the oven consists in a curved bar (70), fixed to the interior side of the oven door (20) at a predetermined height, said height being such that the packaged product (P), before being processed in the oven, can pass beneath said bar (70), but on the other hand interacts with same when it has been processed due to its increase of volume, leading to expulsion thereof during the movement of the oven (2) from the cooking position to the insertion position, as the door (20) opens, the product being expelled onto a ramp (71) for falling towards the exterior of the machine.

15. Dispensing machine as claimed in claim 1, wherein said control means (6) include a programmable cooking timer, which disconnects the power supply of the oven (2) and initiates its travel in order to expel the product (P) when the time programmed on the timer has elapsed.

16. Dispensing machine as claimed in claim 15, wherein said control means (6) include an acoustic sensor capable of detecting the bursting of the popcorn grains, the programmable cooking timer being set in accordance with the frequency of the bursts detected by the aforesaid sensor.

17. Dispensing machine as claimed in claim 1, wherein said control means (6) include a safety mechanism which disconnects the oven (2) when a sensor detects the presence of smoke.

18. Dispensing machine as claimed in claim 1, wherein said control means (6) include a safety timer which disconnects the oven (2) after a certain preset time of operation.

19. Dispensing machine as claimed in claim 1, wherein said cleaning and residue evacuation system comprises a roll of absorbent paper (102) fitted beneath the level of the oven (2), said absorbent paper (102) passing over a shuttle roller (104) situated in the bottom of the oven and by a dragging system (105,106) situated outside the oven, so that the product (P) to be cooked is placed on said paper inside the oven, and means (108) to cut the paper (102) after it has passed through the dragging system (105,106).

20. Dispensing machine as claimed in claim 19, further comprising a continuous strip of flexible material (107)

fitted between the dragging system (105) and the shuttle roller (104), in order to support the paper (102) and the product (P) to be cooked.

21. Dispensing machine as claimed in claim 2, further comprising at least one refrigerated storage zone.

22. Dispensing machine as claimed in claim 21, wherein said at least one refrigerated storage zone contains at least one of the conveyor belts (30), and has a product discharge door controlled by opening and closing means synchronized with the movement of the belt (30) itself.

23. Dispensing machine as claimed in claim 2, further comprising an intermediate storage device, with capacity for one unit of each type of product supplied by the machine, in such a way that in each cycle the pick-up device (4) supplies the oven (2) with a unit of product stored in the intermediate storage device and then picks up another unit of product from one of the conveyor belts (30) and replaces it into the intermediate storage device.

24. Dispensing machine as claimed in claim 1, wherein the structure (1) includes a front section on which are provided the payment device, some buttons for selection of the desired product (P), a display screen, an oven viewing window, an opening associated with the end of the fall ramp (71) and an indicator to show the time remaining for supply of the product (P).

25. Dispensing machine for packaged food product, comprising a structure which has an associated means of payment and which contains a microwave oven, a system for supply of packaged products to the microwave oven, a device for expulsion of the packaged products from the microwave oven, control means for controlling operation of the machine, said system for supply of packaged products to the microwave oven including a storage and dispensing device for the packaged products, a device for collecting said products from the storage and dispensing device, and a device for placing the packaged products in the microwave oven, said storage and dispensing device including a plurality of conveyor belts running parallel to each other, each of said conveyor belts being provided with separating plates articulated onto said belt around spindles mounted transversally to a longitudinal direction of said belt, one packaged product being placed between each two separating plates, and each of said conveyor belts being provided with means for moving forward a predetermined distance.

26. Dispensing machine for packaged food products, comprising a structure which has an associated means of payment and which contains a microwave oven, a system for supply of packaged products to the microwave oven, a device for expulsion of the packaged products from the microwave oven, control means for controlling operation of the machine, said system for supply of packaged products to the microwave oven including a storage and dispensing device for the packaged products, a pick-up device for collecting said products from the storage and dispensing device, and a device for placing the packaged products in the microwave oven, said pick-up device including a collecting platform arranged in relation to the structure with three degrees of freedom of movement, in accordance with three directions orthogonal to each other.

27. Dispensing machine for packaged food products, comprising a structure which has an associated means of payment and which contains a microwave oven, a system for supply of packaged products to the microwave oven, a device for expulsion of the packaged products from the microwave oven, control means for controlling operation of the machine, said system for supply of packaged products to the microwave oven including a storage and dispensing device for the packaged products, a device for collecting said products from the storage and dispensing device, and a device for placing the packaged products in the microwave oven, the microwave oven being mounted on a pair of horizontal guides movable between one product-insertion position and a cooking position, the microwave oven including a door having an associated bushing along which a guide attached to the machine structure travels so that the oven door closes when the oven is moved from the insertion position to the cooking position, and opens when it moves in the opposite direction.

28. Dispensing machine for packaged food products, comprising a structure which has an associated means of payment and which contains a microwave oven, a system for supply of packaged products to the microwave oven, a device for expulsion of the packaged products from the microwave oven, control means for controlling operation of the machine, said system for supply of packaged products to the microwave oven including a storage and dispensing device for the packaged products, a device for collecting said products from the storage and dispensing device, and a device for placing the packaged products in the microwave oven, said control means including a programmable cooking timer which disconnects a power supply of the oven and initiates movement of the oven in order to expel the product when the time programmed on the timer has elapsed, said control means further including an acoustic sensor capable of detecting the bursting of popcorn grains, the programmable cooking timer being set in accordance with the frequency of the bursts detected by the acoustic sensor.

29. Dispensing machine for packaged food products, comprising a structure which has an associated means of payment and which contains a microwave oven, a system for supply of packaged products to the microwave oven, a device for expulsion of the packaged products from the microwave oven, control means for controlling operation of the machine, said system for supply of packaged products to the microwave oven including a storage and dispensing device for the packaged products, a device for collecting said products from the storage and dispensing device, and a device for placing the packaged products in the microwave oven, said control means comprising a safety mechanism which disconnects the oven when a sensor detects the presence of smoke.

* * * * *